US006048139A

United States Patent [19]

Donovan, III

[11] Patent Number: 6,048,139

[45] Date of Patent: Apr. 11, 2000

[54] ARRANGEMENT FOR SHORELINE CONSTRUCTION, MAINTENANCE, AND PROTECTION, AND METHODS FOR MAKING AND USING THE SAME

[76] Inventor: Murtha Vincent Donovan, III, 7201 Harbor La., Columbia, Md. 21045

[21] Appl. No.: 09/010,039

[22] Filed: Jan. 21, 1998

[51] Int. Cl.[7] ..... E02D 29/02

[52] U.S. Cl. ..... 405/284; 405/15

[58] Field of Search ..... 405/15, 21, 31, 405/25, 211, 212, 249, 255, 272, 273, 274, 275, 276, 277, 278, 279, 280, 281, 284, 285, 286

[56] References Cited

U.S. PATENT DOCUMENTS

| | | |
|---|---|---|
| 4,490,071 | 12/1984 | Morrisroe . |
| 4,534,675 | 8/1985 | Morrisroe . |
| 4,715,744 | 12/1987 | Richey . |
| 4,729,691 | 3/1988 | Sample . |
| 4,748,338 | 5/1988 | Boyce . |
| 4,877,349 | 10/1989 | Greene . |
| 4,889,446 | 12/1989 | Holmberg . |
| 4,919,567 | 4/1990 | Sample . |
| 4,954,013 | 9/1990 | Lamberton . |
| 4,966,491 | 10/1990 | Sample . |
| 5,074,707 | 12/1991 | Greene . |
| 5,158,395 | 10/1992 | Holmberg . |
| 5,178,489 | 1/1993 | Suhayda . |
| 5,238,325 | 8/1993 | Krenzler . |
| 5,338,131 | 8/1994 | Bestmann . |
| 5,405,217 | 4/1995 | Dias et al. . |
| 5,425,597 | 6/1995 | Bestmann . |
| 5,429,450 | 7/1995 | Meidinger . |
| 5,465,527 | 11/1995 | Able . |
| 5,536,111 | 7/1996 | Doernemann . |
| 5,558,459 | 9/1996 | Odenbach et al. . |
| 5,575,584 | 11/1996 | Alsop . |
| 5,582,492 | 12/1996 | Doyle, Jr. . |

*Primary Examiner*—Eileen Dunn Lillis
*Assistant Examiner*—Frederick Lagman
*Attorney, Agent, or Firm*—Oblon, Spivak, McClelland, Maier & Neustadt, P.C.

[57] ABSTRACT

An arrangement for shoreline construction, maintenance, and protection, and methods for making and using the same wherein wave energy-absorbent pilings are arranged in rows parallel to a shoreline such that a portion of the pilings are exposed above the water body bottom and filled with soil, thereby absorbing and transferring wave energy to the water body bottom, and where aquatic vegetation is provided in the soil in the pilings resulting in a shoreline that is stable, incorporates natural materials and provides a habitat for aquatic life.

16 Claims, 2 Drawing Sheets

ARRANGEMENT FOR SHORELINE CONSTRUCTION, MAINTENANCE, AND PROTECTION, AND METHODS FOR MAKING AND USING THE SAME

BACKGROUND OF THE INVENTION

1. Field of the invention

This invention relates to a method and apparatus for protecting and maintaining shorelines, and more particularly to such a device for growing aquatic vegetation in soil-filled, wave energy-absorbent pilings.

2. Discussion of the Background

Wave and current movements cause erosion and sedimentation where water transfers energy to shorelines. Typical methods of halting this process fall into two categories. Sheet piling and retaining wall methods place a barrier that reflects wave energy, by providing a vertical surface at the land/water interface. Riprap or revetment construction methods employ a sloped hard surface to achieve the same result. The construction elements used for the above methods are rarely in harmony with nature, as corrosion-resistant materials available are generally employed in their construction. These methods of construction have resulted in vast stretches of shoreline that have no natural interface where land and water meet, and which do not take advantage of energy-absorbing properties of natural materials. In addition, wave reflecting construction practices typically lead to greater erosion adjacent to them, where the energy has been redirected. There is a need therefore for a stabilization method that is wave energy- absorbing, natural, and can be integrated into a structural design sufficient to withstand strong water forces.

U.S. Pat. No. 5,178,489issued to Suhayda discloses a shoreline protection technique that incorporates used automobile tires into walls or baffles used to absorb wave energy, divert water, and trap sediment. According to Suhayda, the tires are anchored to a water body bottom via pilings 58. However, Suhayda fails to incorporate natural materials, and contributes to water pollution by submerging automobile tires into water.

U.S. Pat. No. 5,338,131issued to Bestmann overcomes some of the problems associated with traditional methods of shoreline protection. Bestmann discloses a shoreline construction technique that incorporates precultivated, emergent aquatic plants whose roots are held within a water-permeable, biodegradeable vegetative carrier system, and other botanical elements to protect shorelines. However, according to Bestmann the botanical elements are anchored by varying methods of staking the elements into the shoreline, a labor intensive approach which provides limited wave energy resistance. For example, Bestmann discloses an aquatic plant 14 rooted in a plant plug 12 which is disposed in a substrate 31. However, substrate 31 is disposed flush with the existing shoreline, and horizontal at its upper end, thereby offering little or no wave energy absorption. The elements used by Bestmann, such as "layers of biodegradable non-woven felt" and "geotextiles" can be cost prohibitive for large projects. Furthermore, biodegradable felt is a temporary stabilization measure meant to retard erosion only until it has biodegraded, after which it provides no further stabilization properties. Using such materials and methods requires extensive regrading of the shoreline area to create a nearly flat shoreline, which is labor intensive and cause erosion in and of itself

SUMMARY OF THE INVENTION

Accordingly, an object of the present invention is to provide an arrangement for shoreline construction, maintenance and protection which incorporates ecological elements on or about structures, which allows the creation of habitat area on or about structures at the land/water interface.

Another object of the present invention is to provide an arrangement for shoreline construction, maintenance and protection which uses ecological elements placed on or about structures, which allows the use of the wave absorbing properties of natural materials on or about structures to reduce or prevent erosion.

Another object of the present invention is to provide an arrangement for shoreline construction, maintenance and protection which uses ecological elements placed on or about structures, which provides additional area for the growth of plants, which filter pollutants, and trap sediments.

Another object of the invention is to provide a method for the placement of ecological elements on or about shorelines in a manner that reduces or prevents erosion of the stratum in which the elements are placed.

Another object of the invention is to provide a low-cost method for the placement of ecological elements on or about shorelines in a manner that provides substantial wave energy absorption.

These and other objects are achieved by providing a tubular piling system including a plurality of closely stacked hollow pilings arranged along a shoreline wherein the pilings have a bottom portion embedded in the water body bottom and an upper portion protruding above the water body bottom such that the upper portion absorbs and transfers wave energy to the water body bottom via the bottom portion. The upper ends of the pilings are beveled to mimic natural stable slopes and incorporate plant materials to mimic natural habitat areas.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawing, wherein.

DETAILED DESCRIPTION OF THE PREFERRED EMBODIMENTS

Figure 1:
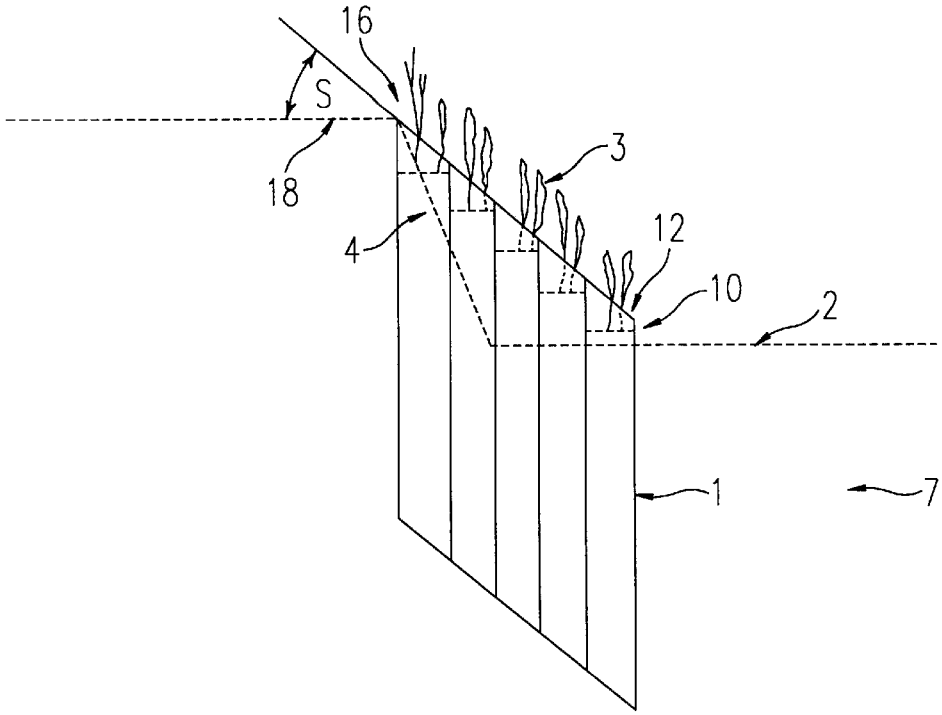
FIG. 1 is a cross-sectional view of an embodiment for a planting area tube.

Referring now to the drawings wherein like reference numerals designate identical or corresponding parts throughout the several views, and more particularly to FIG. 1 thereof, FIG. 1 illustrates the construction of one embodiment of the arrangement for shoreline construction, maintenance, and protection according to this invention. In this embodiment, a plurality of pilings 1 are anchored into the water body bottom 2 adjacent the shoreline.

Each of the pilings 1 have upper end 10 and lower end 14, and are constructed of a corrosion resistant material, such as polyvinyl chloride (PVC), polyethylene, painted fiberglass, fiberglass reinforced plastic, stainless steel, ceramic, or teflon, however, PVC is widely available in various shapes, thicknesses, and strengths. Pilings 1 are preferably formed into tube or pipes with an inner diameter of4 to 12 inches and wall thickness of approximately 0.25 to 0.5 inches. Wider tubes would be more susceptible to erosion, as the soil plug is kept in place by friction between soil particles and the tube. Other cross sectional shapes such as rectangular, pentagonal, hexagonal or ovoid can be used, however, flat surfaces tend to reflect energy and corners are susceptible to increased scour if in direct contact with waves. An ovoid cross section would be acceptable, but is not currently mass produced. Pilings 1 with round cross sections are widely available, have equal energy transfer no matter which direction the wave energy comes from, and are therefor preferred.

Lower ends 14 of pilings 1 are anchored into water body bottom 2. Preferably, lower ends 14 are driven to a depth consistent with the anticipated wave energy to be absorbed by pilings 1. Typically, pilings 1 must be driven to a minimum depth equal to eight times the tube diameter, e.g. a six inch diameter piling 1 would be driven 48 inches into water body bottom 2. Upper ends 10 protrude a short distance above the water body bottom 2 adjacent the shoreline, typically upper ends 10 are either approximately flush or protrude above water body bottom 2 up to a height equal to the diameter of piling 1.

Pilings 1 are stacked a distance W outwardly from shoreline. Typically, distance W is 3.3 times the height difference D, rounded to the nearest piling diameter, where height D is equal to the difference in elevation between water body bottom 2 and stable soil 18. Once embedded into the bottom 2, pilings are filled with soil 4. Aquatic plants 3 are anchored into the soil 4 provided in the tube interior. Plants 3 vary according to the particular climate and anticipated water levels at the installation site.

Preferably, the height of soil 4 in pilings 1 is such that a cavity 12 is formed between the top of soil 4, an inner wall 22 of upper end 10, and an aperture 20 formed in upper end 10 of pilings 1. Cavity 12 is thus capable of trapping sediments from water body 7 and allowing uptake of a variety of substances by the plants. The cavity will have a cross section equal to that of the piling 1, and a height approximately equal to the diameter of piling 1. The level of soil 4 would be maintained by friction along the interior of pilings 1. As the diameter of piling 1 is increased, so does the mean distance from inner wall 22 to a particle of soil. Therefore, large diameter pilings 1 must be filled with clay soils, mid-sized diameter pilings 1 would function best with loamy soils, and small diameter pilings 1 would work best with sandy soils.

Figure 2:
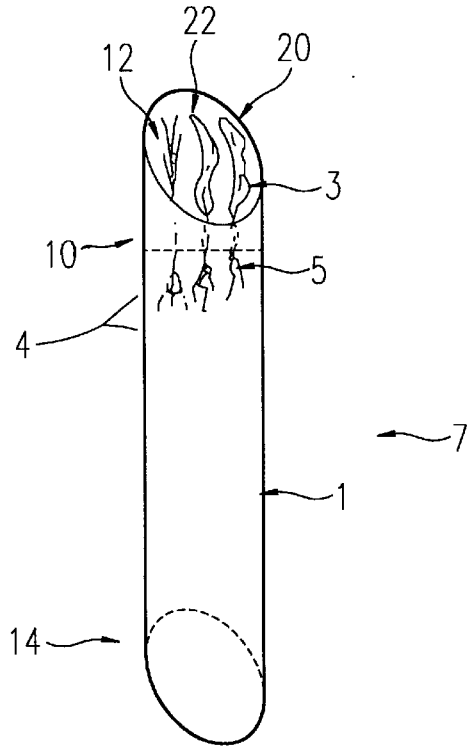
FIG. 2 is a perspective view of the embodiment shown in FIG. 1.
Figure 3:
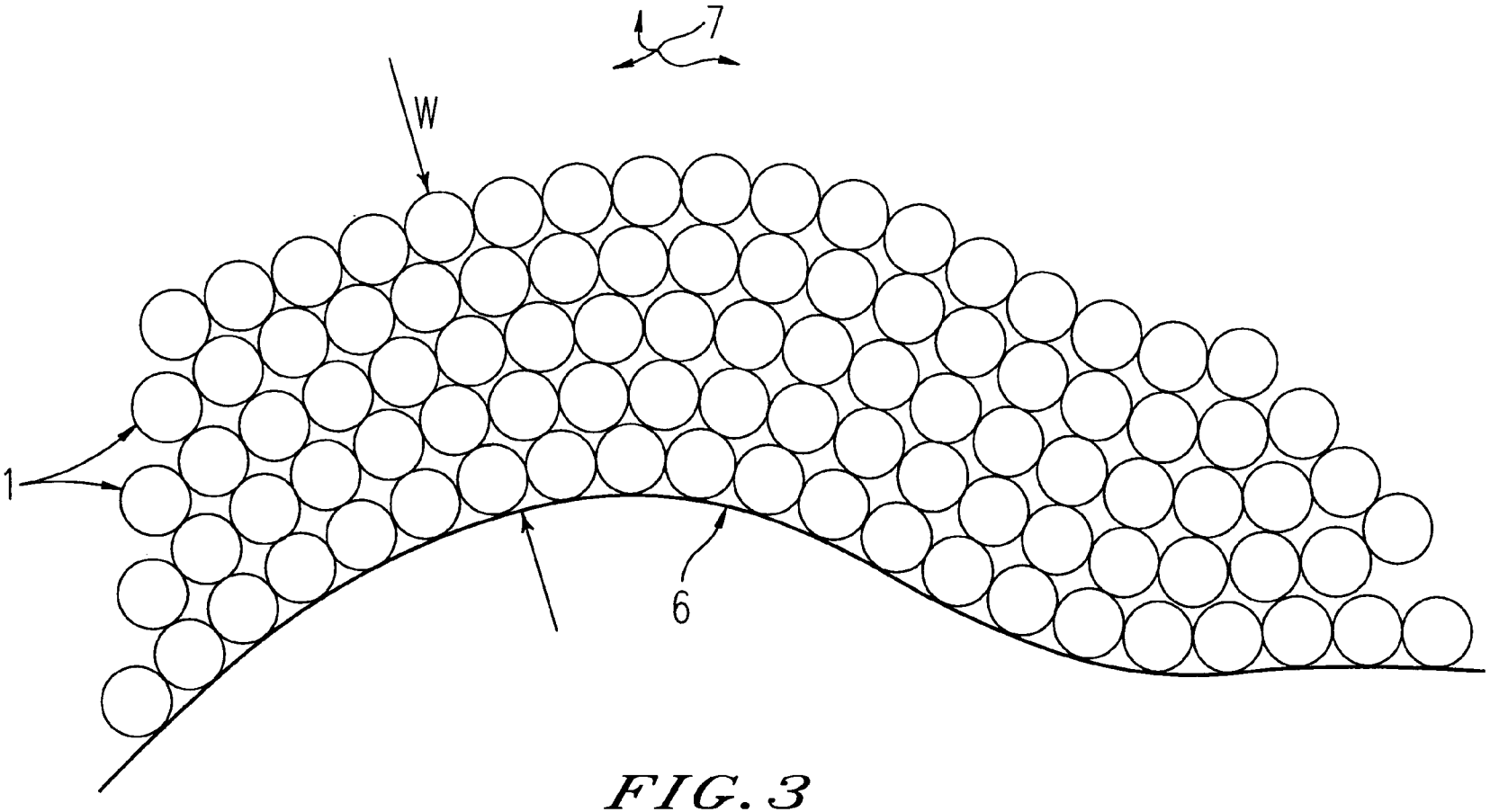
FIG. 3 is a plan view of a typical installation.

As illustrated in FIGS. 2 and 3 and as noted above, pilings 1 would preferably be installed in rows parallel to the shoreline, thereby creating a wall of width W between the water body 7 and the shoreline 6. It is possible to increase the rigidity of the resulting wall of pilings 1 by attaching interlocking joints (not shown) between pilings, however, this would significantly add to production and installation costs.

By constructing pilings 1 from material such as PVC pipe or tubing, pilings 1 would have only limited strength and wave energy absorption ability. However, by driving closely spaced pilings 1 into water bottom 2 and filling pilings 1 with soil 4, the strength and wave energy absorption ability of pilings 1 are supplemented by being buttressed by adjacent pilings, by soil 4 and partially by material from bottom 2 that fills lower end 14 of piling 1 during anchoring. By installing pilings 1 in such a way, the present invention effectively maximizes the use of natural materials such as soil 4 and bottom 2, in contrast to barriers made wholly of fabricated structures such as pilings and walls made of cement or steel. Furthermore, because of the shape of pilings 1 and the inherent flexibility of PVC, wave energy is effectively absorbed by piling 1, reflected upwards by beveled upper ends 10, and absorbed by plants 3, rather than being reflected to an opposite shoreline.

As shown in FIG. 2, The upper ends 10 of pilings 1 are preferably cut on a slant facing the water body 7 so that the resulting slope 16 of the upper ends of the pilings 1 matches the slope of a stable slope for the installation site. Stable slopes are sometimes formed in nature where the combination of angle of the slope and plant life growing on the slope result in a shoreline that can withstand wave energy without erosion. A slope that rises 0.33 feet per foot of lateral extension, or a slope of approximately 18 degrees, is an accepted stable slope condition under known engineering standards. With pilings 1 cut and arranged in such a way as to mimic a stable slope with angle S being approximately 18 degrees, pilings 1 take advantage of the geometry best suited for wave energy absorption, while minimizing the width W of the piling arrangement, and thereby minimizing the cost of the apparatus. Furthermore, the sloped arrangement of pilings 1 and plants 3 simulates a natural habitat, and encourages wildlife to utilize the habitat.

Alternatively, some of upper ends 10 of pilings 1 may be positioned so that cavity 12 faces the shoreline, thereby forming better protected habitat sites. Another advantage gained by facing at least some of cavities 12 toward the shore line is that sediments are better trapped in cavities 12 as water recedes from the shoreline.

The method for making and using the invention includes a pile anchoring step, a pile filling step, and a planting step. During the pile anchoring step, pilings 1 are anchored into the water body bottom 2, by partially burying them, or preferably, pile driving. In the anchoring step, pilings are arranged substantially as shown in FIG. 3. To protect upper ends 10 of pilings 1 during pile driving, pilings 1 may be fitted with a removable protective hood (not shown) that includes a main boss, an inner sleeve and an outer sleeve, arranged to sandwich the wall of upper ends 10 of pilings 1, and uniformly contact the upper edge of upper ends 10. Constructed as such, the protective hood would evenly distribute the impact shock of the pile driver, thereby avoiding damage to pilings 1 during pile driving.

In the pile filling step, pilings 1 are filled with soil 4, where soil 4 is chosen according to the particular climate, anticipated water levels and the type of aquatic plants 3 to be planted in soil 4. In the planting step, plants 3 are planted in soil 4, where plants 3 are chosen according to the particular climate and anticipated water levels.

Obviously, numerous additional modifications and variations of the present invention are possible in light of the above teachings. It is therefore to be understood that within the scope of the appended claims, the present invention may be practiced otherwise than as specifically described herein.

What is claimed as new and desired to be secured by Letters Patent of the United States is:

1. A shoreline apparatus comprising:

a plurality of closely laterally stacked hollow pilings arranged along a shoreline, said pilings having a bottom portion embedded in a water body bottom and an upper portion protruding above the water body bottom, said upper portion absorbing and transferring wave energy to the water body bottom via the bottom portion;

soil provided in said pilings;

aquatic plants provided in said soil; and wherein said pilings are cut at a slant relative to a longitudinal axis of the piling, at an upper end of the upper portion, thereby forming a slanted upper opening.

2. An apparatus according to claim 1, wherein said pilings are tubular.

3. An apparatus according to claim 1, wherein said pilings are constructed out of a corrosion resistant material.

4. An apparatus according to claim 1, wherein said pilings are constructed out of at least one of PVC, polyethylene, painted fiberglass, fiberglass reinforced plastic, stainless steel, ceramic, and teflon.

5. An apparatus according to claim 1, wherein said pilings are arranged such that said adjacent pilings are in contact with each other.

6. An apparatus according to claim 1, wherein plural of said pilings are arranged such that said slanted upper openings face away from the shoreline.

7. An apparatus according to claim 1, wherein plural of said pilings are arranged such that said slanted upper openings thereof face toward the shoreline.

8. An apparatus according to claim 6, wherein plural of said pilings are arranged such that said slanted upper openings thereof face toward the shoreline.

9. An apparatus according to claim 1, wherein upper ends of said pilings are substantially aligned along a plane which is parallel to a stable slope of an installation site of said apparatus.

10. An apparatus according to claim 1, wherein said soil is able to maintain aquatic plant life at an installation site of said apparatus, said soil forming a cavity at upper ends of said pilings.

11. An apparatus according to claim 1, wherein said aquatic plants are able to survive in water levels and climate of an installation site of said apparatus.

12. A method of preparing a shoreline arrangement adjacent a shoreline having a variable level of water, comprising the steps of:

anchoring a plurality of pilings along the shoreline with a piling bottom portion embedded in a water body bottom and a piling upper portion protruding above the water body bottom so that said upper portion absorbs and transfers wave energy to the water body bottom via the bottom portion;

filing said pilings with soil;

planting aquatic plants into said soil; and wherein said anchoring step comprises arranging said pilings so that upper ends of said pilings are aligned with a surface which is parallel with a stable slope at the installation site.

13. A method according to claim 12, wherein said anchoring step comprises pile driving said pilings into at least one of the shoreline and water body bottom so that water bottom material enters lower ends of said pilings.

14. A method according to claim 12, wherein said anchoring step comprises arranging said pilings close enough such that adjacent pilings contact each other.

15. A method according to claim 12, wherein said filling step comprises filling said pilings with soil to a height such that a cavity is formed between said soil and upper opening of said piling.

16. A method according to claim 12, wherein said anchoring step comprises arranging said pilings so that upper ends of said pilings at a slope of approximately 18 degrees at the installation site.

* * * * *